US005716235A

United States Patent [19]

Endo et al.

[11] Patent Number: 5,716,235

[45] Date of Patent: Feb. 10, 1998

[54] REAR HOLDER INTEGRAL-TYPE CONNECTOR

[75] Inventors: Takayoshi Endo; Yuji Hatagishi; Kimihiro Abe, all of Shizuoka, Japan

[73] Assignee: Yazaki Corporation, Tokyo, Japan

[21] Appl. No.: 552,567

[22] Filed: Nov. 3, 1995

[30] Foreign Application Priority Data

| | | | |
|---|---|---|---|
| Nov. 4, 1994 | [JP] | Japan | 6-271400 |
| Feb. 24, 1995 | [JP] | Japan | 7-037083 |

[51] Int. Cl.[6] ..... H01R 13/40

[52] U.S. Cl. ..... 439/596

[58] Field of Search ..... 439/752, 596

[56] References Cited

U.S. PATENT DOCUMENTS

| | | | |
|---|---|---|---|
| 4,200,350 | 4/1980 | Zimmerman, Jr. | 439/752 X |
| 4,759,723 | 7/1988 | Siemon | 439/596 X |
| 5,141,452 | 8/1992 | Yoneda et al. | 439/752 X |
| 5,147,222 | 9/1992 | Hotea et al. | 439/752 X |

FOREIGN PATENT DOCUMENTS

| | | |
|---|---|---|
| 249656 | 12/1990 | Japan . |
| 1447910 | 9/1976 | United Kingdom . |
| A2071926 | 9/1981 | United Kingdom . |
| A2122036 | 1/1984 | United Kingdom . |

*Primary Examiner*—Neil Abrams
*Assistant Examiner*—Daniel Wittels
*Attorney, Agent, or Firm*—Sughrue, Mion, Zinn, Macpeak & Seas, PLLC

[57] ABSTRACT

A rear holder integral-type connector is constituted by a hollow rectangular housing body made from resin, and rear holders coupled integrally with the upper and lower walls of the housing body through displaceable hinges respectively. The rear holders are bent, at a position displaced from the fore side of the upper wall of the housing body to the rear side slightly, toward the fore side with the displaceable hinges as pivotal axes. The housing body and the rear holders which are disposed back to back, are temporarily fixed by temporary fixation hinges. These temporary fixation hinges are formed integrally with the housing body and the rear holders. Locking side pieces for locking are provided at the both side ends of the rear holders, and locking grooves are provided at a rear end portion of the housing body.

9 Claims, 7 Drawing Sheets

REAR HOLDER INTEGRAL-TYPE CONNECTOR

BACKGROUND OF THE INVENTION

The present invention relates to a rear holder integral-type connector in which a rear holder is integrally formed in a housing body of the connector, and particularly relates to a rear holder integral-type connector in which a rear holder is fixed to a housing body temporarily in a condition that the rear holder is opened.

As a rear holder integral-type connector constituted by a housing body receiving connection terminals and a rear holder, conventionally, generally known is such a rear holder integral-type connector as disclosed in Japanese Utility-Model Publication No. Hei-2-49656, or the like.

As shown in FIG. 17, in a rear holder integral-type connector 64, a rear holder 65 is coupled with a housing 60 having terminal reception chambers through a band-like hinge 67. The hinge 67 is formed so thin that the rear holder 65 can be locked on the housing 60 easily after terminals are installed in the terminal reception chambers, and the hinge 67 is made displaceable not to interfere with the working of the installation by the repulsion of the hinge, or the like.

In such a conventional rear holder integral-type connector as mentioned above, however, there has been a problem that a fault such as deformation, break-down or damage is apt to occur in a hinge or a rear holder when the connector is put around at the manufacture of a wire harness.

Further, because the position of the rear holder is not stable when parts such as connection terminals are installed by an automatic installer, the working of mounting the connector onto the automatic installer becomes troublesome. In addition, the rear holder becomes an obstacle when the parts are installed onto the connector, so that the workability is poor.

SUMMARY OF THE INVENTION

Taking the foregoing problems into consideration, the present invention has an object to provide a rear holder integral-type connector in which a hinge and a rear holder are not deformed or broken down even if they contact with other parts at the time of installation, and the working of installation can be performed easily.

In order to attain the above object, according to the present invention, a rear holder integral-type connector comprising a housing body including a plurality of terminal reception chambers for receiving connection terminals to which electric wires are connected respectively, and a rear holder coupled with the housing body through a displaceable hinge, is characterized in that there is provided a separable temporary fixation member for temporarily fixing the rear holder to the housing body in a condition that the rear holder is opened.

Preferably, the temporary fixation member may be a temporary fixation hinge which is formed integrally to couple the housing body and the rear holder with each other and which is cut off when the rear holder is closed.

Preferably, an appropriate number of thin portions may be provided in the temporary fixation member.

Preferably, a thin portion may be provided in a center portion of the temporary fixation member, and guide ribs are provided integrally with the temporary fixation member at the both sides of the thin portion respectively.

Preferably, thin portions may be provided at upper and lower ends of the temporary fixation member while a middle thick portion is provided at a center portion of the temporary fixation member, and ribs each of which has a stopper portion and a fulcrum portion may be provided at the rear side of the temporary fixation member above and below the middle thick portion respectively.

Preferably, locking side pieces may be provided on the rear holder, and locking grooves for locking the locking side pieces when the rear holder is closed may be provided in the housing body.

Preferably, the temporary fixation member may be a temporary locking projection provided on the housing body to temporarily lock a locking hole provided in at least one side end of the rear holder.

The rear holder integral-type connector according to the present invention has a separable temporary fixation member for temporarily fixing a rear holder to a housing body in the condition that the rear holder is opened.

As a result, since the temporary fixation member temporarily fixes the rear holder to the housing body in the condition that the rear holder is opened, there is no case where the rear holder or the hinge is damaged even if an external force is given to the connector when the connector is carried. In addition, the rear holder is not an obstacle when terminals are inserted or when wires are connected, so that the workability can be improved.

Preferably, the temporary fixation member is a temporary fixation hinge which is formed integrally to couple the housing body and the rear holder with each other, and which is cut off when the rear holder is closed.

Thus, since such a temporary fixation hinge is provided so as to be able to be cut off, the work to lock the rear holder onto the housing body can be easily performed by cutting the hinge off after working.

Preferably, an appropriate number of thin portions are provided in the temporary fixation member. As a result, the temporary fixation member can be easily cut off with empty hands or a simple tool and at a constant place, so that the working of locking of the rear holder on the housing can be improved.

Further, when the thin portions are provided at the both ends of the temporary fixation member, the temporary fixation member do not remain on the housing after the temporary fixation member is cut off. Accordingly, there is no fear that another member twines around the temporary fixation member, or a worker is injured by the cut-off position.

Preferably, a thin portion is provided at a center portion of the temporary fixation member, and guide ribs are provided integrally with the temporary fixation member at the both ends of this thin portion respectively. As a result, the connector can be made to fit to a mate connector easily. Accordingly, the workability can be improved.

Preferably, thin portions are provided at upper and lower ends of the temporary fixation member while a middle thick portion is provided at a center portion thereof, and ribs each of which has a stopper portion and a fulcrum portion are provided at the rear side of the temporary fixation member above and below the middle thick portion respectively.

As a result, the stopper portions of the respective ribs contact with each other so that the further deformation of the temporary fixation member can be prevented even if an external force is given to the rear holder. Accordingly, the temporary fixation member is protected from the external force so that the reliability can be improved. In addition, both the fulcrum portions contact with the rear holder and the housing when a pushing force is given to the rear of the temporary fixation member. Accordingly, the thin portions can be cut off easily, and the temporary fixation member do not remain on the housing. Accordingly, the workability can be improved, and the reliability of the connector and the security of the worker can be made ensured.

Preferably, locking side pieces are provided on the rear holder, and locking grooves for locking the locking side pieces when the rear holder is closed are provided in the housing body.

As a result, the locking side pieces of the rear holder are locked in the locking grooves of the housing body, so that the rear holder can prevent connection terminals from surfacing more surely.

Preferably, the temporary fixation member is a temporary locking projection provided on the housing body to temporarily lock a locking hole provided in at least one side end of the rear holder.

As a result, the locking hole of the rear holder is locked onto the temporary locking projection provided on the housing body, so that the working of opening and closing the rear holder can be easily performed without using any tools.

DETAILED DESCRIPTION OF THE INVENTION

Figure 1:
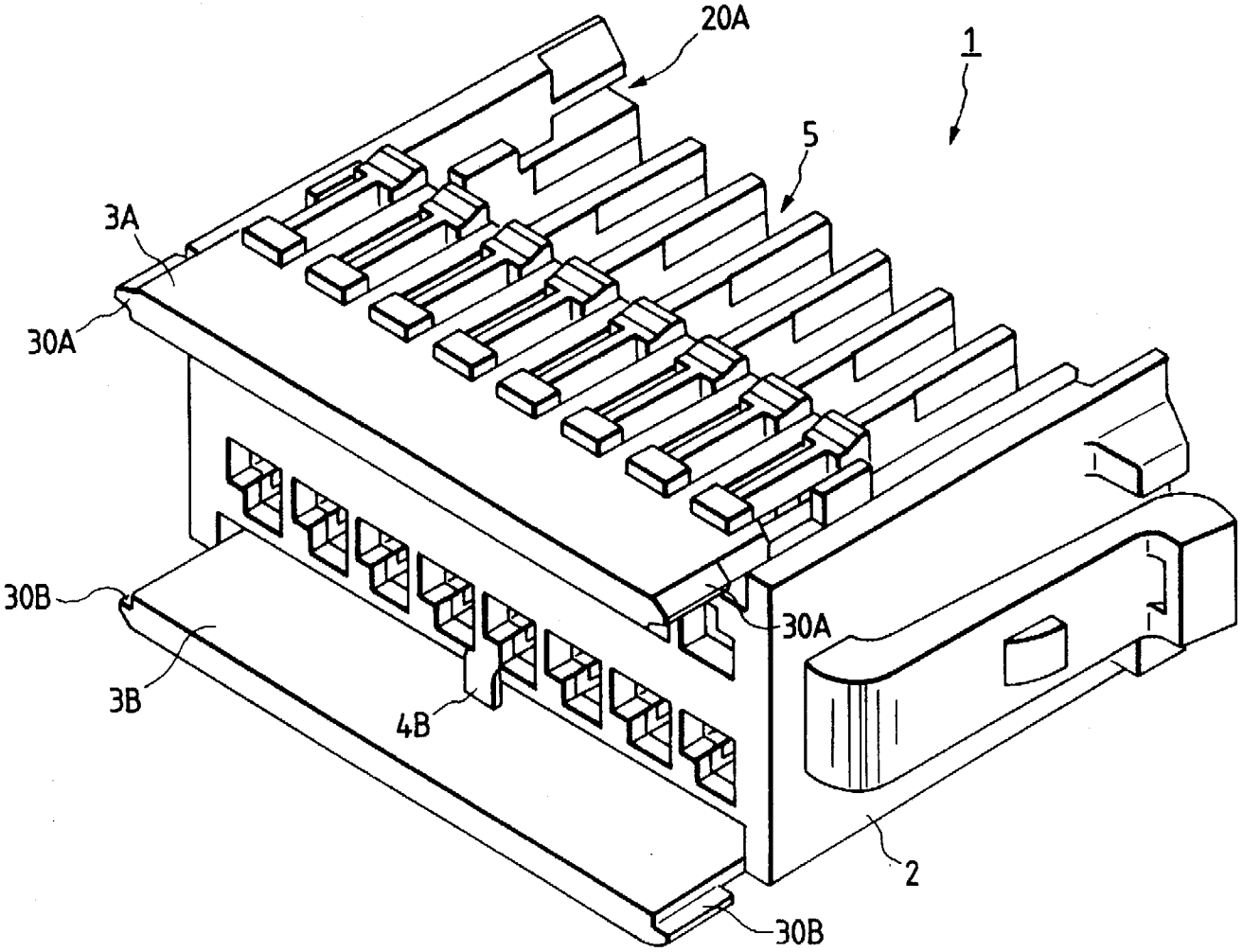
FIG. 1 is a perspective view illustrating a first embodiment of a rear holder integral-type connector according to the present invention.
Figure 2:
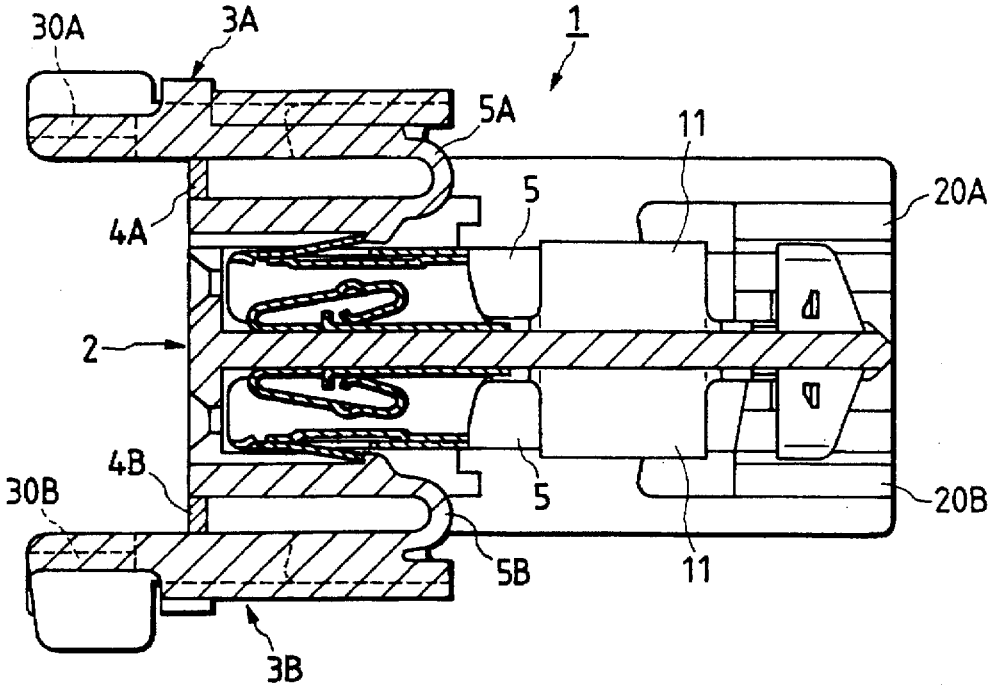
FIG. 2 is a sectional view illustrating the state in which a rear holder in FIG. 1 is fixed temporarily.
Figure 3:
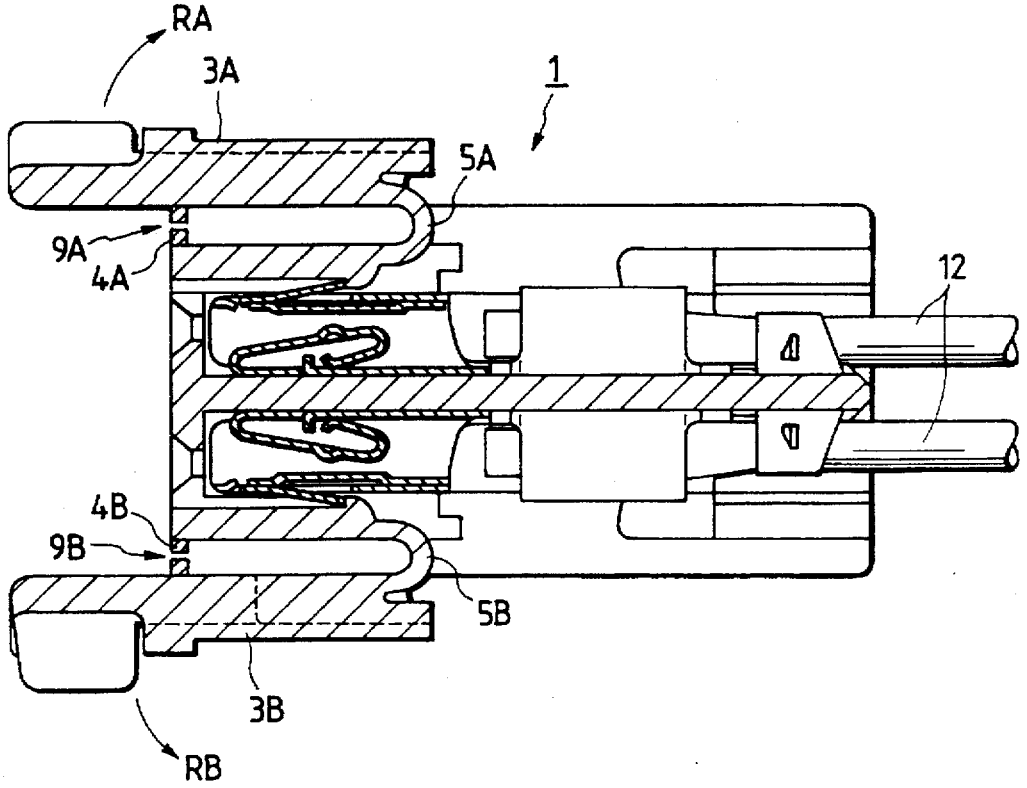
FIG. 3 is a sectional view illustrating the state in which the rear holder in FIG. 2 is released from temporary fixation.
Figure 4:
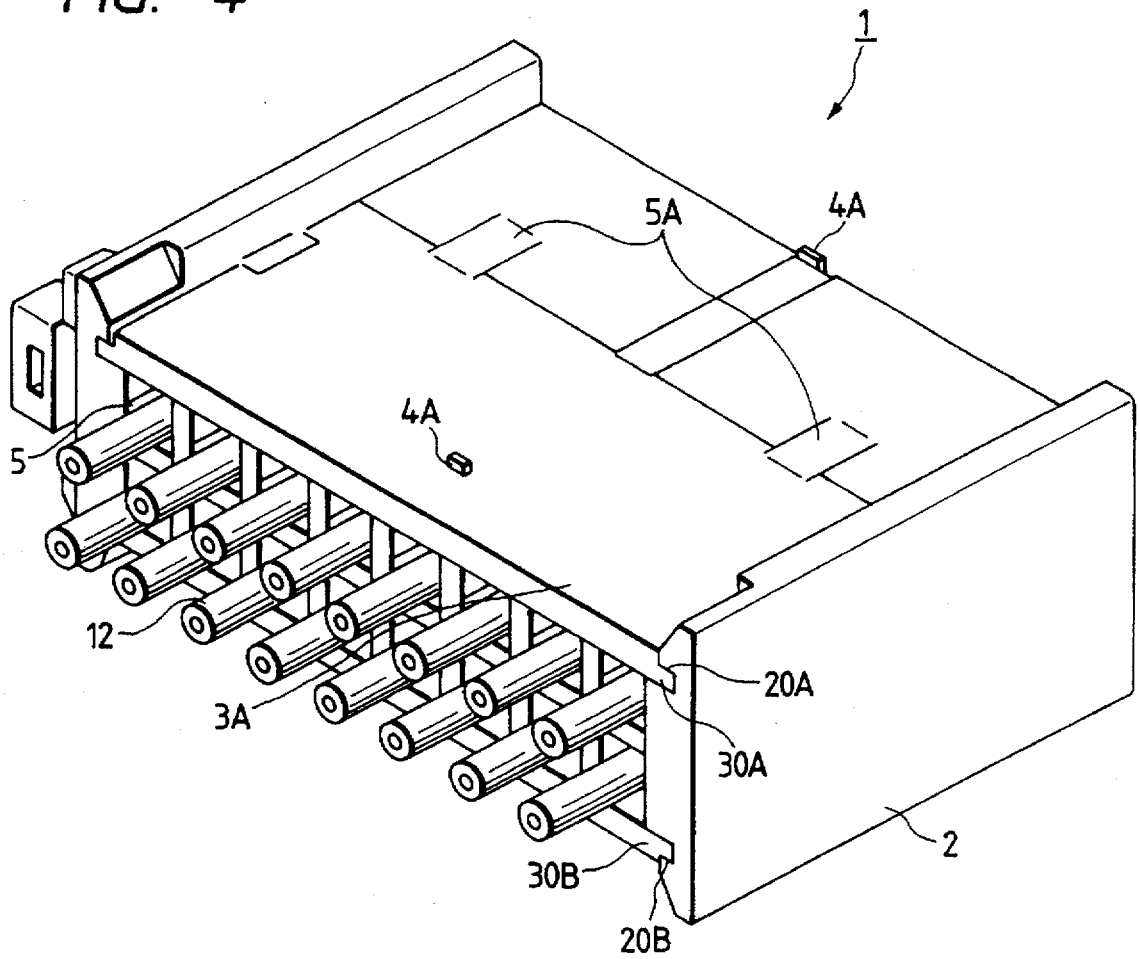
FIG. 4 is a perspective view illustrating the state in which terminals have been installed in FIG. 1.
Figure 5:
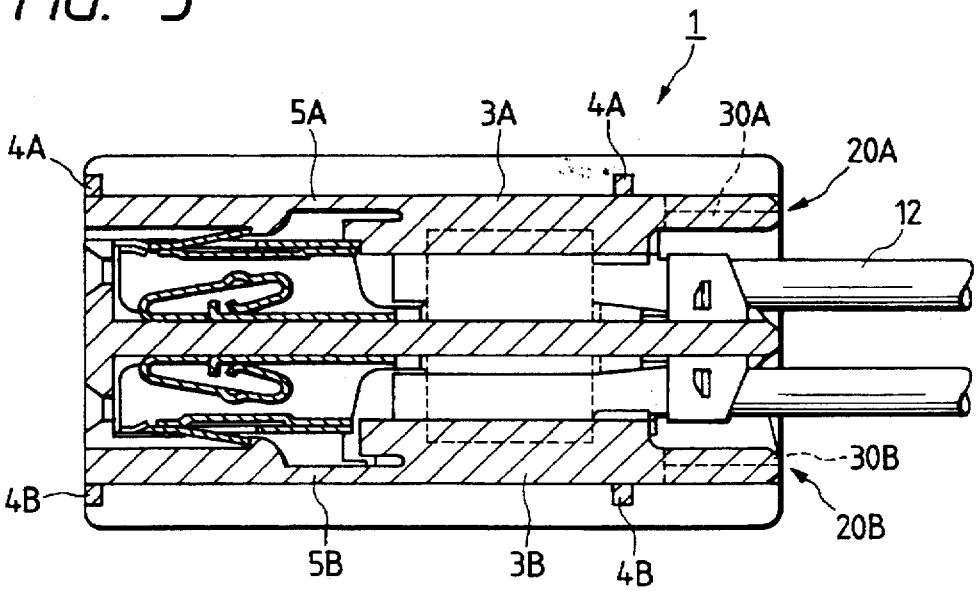
FIG. 5 is a sectional view in FIG. 4.

A first embodiment of a rear holder integral-type connector according to the present invention will be described below with reference to FIGS. 1 to 5. FIG. 1 is a perspective view illustrating the first embodiment of the rear holder integral-type connector according to the present invention; FIG. 2 is a sectional view illustrating the state in which a rear holder in FIG. 1 is fixed temporarily; FIG. 3 is a sectional view illustrating the state in which the rear holder is released from temporary fixation of FIG. 2; FIG. 4 is a perspective view illustrating the state in which terminals have been installed; and FIG. 5 is a sectional view of FIG. 4.

As shown in FIGS. 1 and 2, a rear holder integral-type connector 1 is constituted by a housing body 2 made from resin into a hollow rectangular solid, and rear holders 3A and 3B coupled integrally with the upper and lower walls of this housing body 2 through displaceable hinges 5A and 5B respectively. Top and bottom, two stages of terminal chambers 5 which can receive a plurality of connection terminals 11 therein are formed in this housing body 2, and the connection terminals 11 are inserted from the rear of the terminal reception chambers 5 and installed therein.

The rear holder 3A is bent, from a position displaced from the fore side of the upper wall of the housing body 2 to the rear side slightly, toward the fore side with the displaceable hinge 5A as a pivotal axis. The upper wall of the housing body 2 and the rear holder 3A disposed back to back are temporarily fixed by a temporary fixation hinge 4A. This temporary fixation hinge 4A is formed integrally with the upper wall of the housing body 2 and the rear holder 3A. The temporary fixation hinge 4A is not cut off easily even if an external force is given in the direction in which the rear holder 3A is closed, but can be cut off easily with a proper cutting tool.

In the same manner, the rear holder 3B is bent from a position displaced, from the fore side of the lower wall of the housing body 2 to the rear side slightly, toward the fore side with the displaceable hinge 5B as a pivotal axis. The lower wall of the housing body 2 and the rear holder 3B disposed back to back are temporarily fixed by a temporary fixation hinge 4B. This temporary fixation hinge 4B is formed integrally with the lower wall of the housing body 2 and the rear holder 3B. The temporary fixation hinge 4B is not cut off easily even if an external force is given in the direction in which the rear holder 3B is closed, but can be cut off easily with a proper cutting tool.

Connection terminals 11 to which electric wires 12 are to be connected are received in the terminal reception chambers 5 respectively as shown in FIG. 2. The electric wires 12 are respectively pressed and connected to their corresponding connection terminals 11 by an automatic installer, or the like. The electric wires 12 connected to the connection terminals 11 are led out from the rear openings of the terminal reception chambers 5.

Since the rear holders are thus fixed temporarily as they are left open, working in each step of installation, such as a step of inserting terminals into the housing body, a step of connecting electric wires, or the like, can be performed smoothly.

After the electric wires 12 are connected in the housing body 2 as mentioned above, the temporary fixation hinges 4A and 4B temporarily fixing the rear holders 3A and 3B are cut off at cut-off portions 9A and 9B by a cutting tool, or the like, respectively. The rear holders 3A and 3B released from temporary fixation by this cutting-off of the temporary fixation hinges, are rotated in the directions of the arrows RA and RB in FIG. 3 with the displaceable hinges 5A and 5B as pivotal axes respectively.

Locking side pieces 30A and 30B provided at both ends of the rear holders 3A and 3B are locked into locking grooves 20A and 20B of the housing body 2 as shown in FIGS. 4 and 5. Then the working of installation is completed. By this locking of the rear holders 3A and 3B with the housing body 2, there appears a conspicuous effect that the connection terminals 11 received in the housing body 2 are protected from an external force, and the connection terminals 11 are strongly restrained from surfacing upward or downward by the lower surfaces of the rear holders 3A and 3B.

Figure 6:
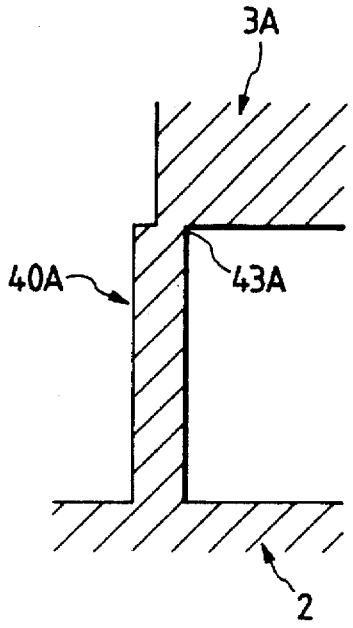
FIG. 6 is a sectional view illustrating an example of a temporary fixation member in a second embodiment of a rear holder integral-type connector according to the present invention.
Figure 7:
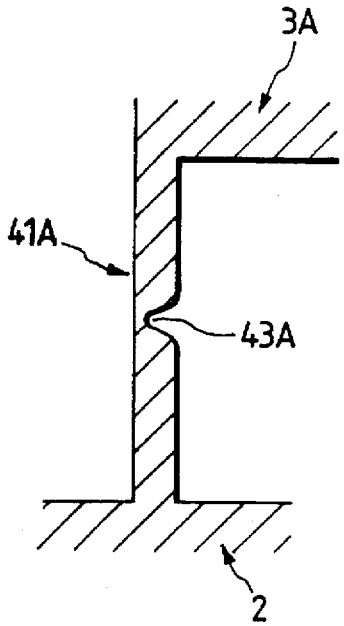
FIG. 7 is a sectional view illustrating another example of the temporary fixation member in the second embodiment according to the present invention.
Figure 8:
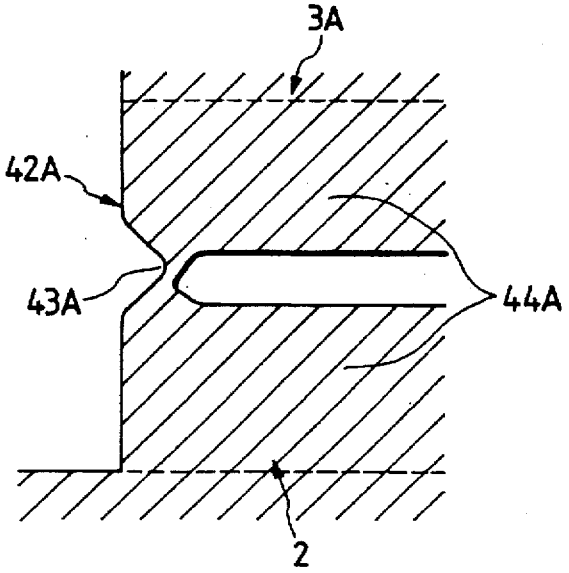
FIG. 8 is a sectional view illustrating further another example of the temporary fixation member in the second embodiment according to the present invention.

Next, a second embodiment of the rear holder integral-type connector according to the present invention will be described with reference to FIGS. 6 to 8. FIG. 6 is a sectional view illustrating an example of a temporary fixation member in the second embodiment of the rear holder integral-type connector according to the present invention; FIG. 7 is a sectional view illustrating another example of the temporary fixation member; and FIG. 8 is a sectional view illustrating further another example of the temporary fixation member.

This second embodiment is different from the above-mentioned first embodiment in the point that the configuration of the temporary fixation hinge portion is modified.

A thin portion 43A is provided at the upper end of a temporary fixation hinge 40A, that is, on a rear holder 3A side, as shown in FIG. 6. Therefore, the temporary fixation hinge 40A can be easily cut off at the thin portion 43A with empty hands or a simple tool such as a driver, or the like. Accordingly, the rear holder 3A is rotated with a displaceable fixation hinge 5A as a pivotal axis, and installed on terminal reception chambers 5. Then, the temporary fixation hinge 40A still lie on the housing body 2 side.

Therefore, the working efficiency of installation is improved, and the cut-off portion is defined so that the reliability of the connector can be also improved.

Next, a temporary fixation hinge 41A has, at its center portion, a thin portion 43A as shown in FIG. 7. Therefore, the temporary fixation hinge 41A can be cut off with empty hands or a simple tool in the same manner as the above-mentioned temporary fixation hinge 40A, and then, the temporary fixation hinge 41A is divided into two, a half on the housing body 2 side and the other half on the rear holder 3A side. Accordingly, the working efficiency of installation is improved, and the cut-off portion is defined. In addition, since the temporary fixation hinge 41A is divided equally into halves on the housing body 2 side and on the rear holder 3A side, the reliability of the connector can be also improved.

Next, as shown in FIG. 8, a temporary fixation hinge 42A has, in its center portion, a thin portion 43A and guide ribs 44A for guiding a mate connector are provided continuously at the rear of this thin portion 43A. Therefore, the temporary fixation hinge 42A can be cut off with empty hands or a simple tool in the same manner as the above-mentioned temporary fixation hinge 40A or 41A, and the guide ribs 44A on the housing body 2 side and on the rear holder 3A side guide the mate connector when the connectors are fitted to each other, so that the working of the fitting can be performed surely and easily. Accordingly, the working efficiency of installation can be improved, and the reliability of the connector can be also improved.

Next, a third embodiment of a rear holder integral-type connector according to the present invention will be described with reference to FIG. 9. This third embodiment is different from the first embodiment in the point that the configuration of a temporary fixation hinge portion is modified.

Figure 9:
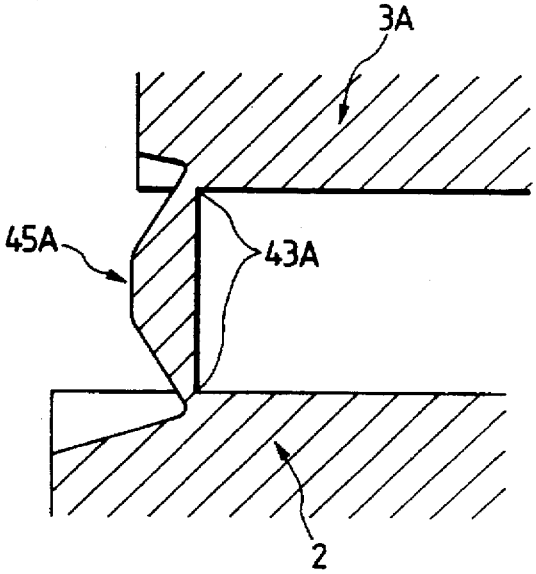
FIG. 9 is a sectional view illustrating an example of a temporary fixation member in a third embodiment of a rear holder integral-type connector according to the present invention.

As shown in FIG. 9, a temporary fixation hinge 45A has thin portions 43A at its both end sides, that is, on the housing body 2 side and on the rear holder 3A side. Therefore, the temporary fixation hinge 45A can be cut off with empty hands or a simple tool in the same manner as the above-mentioned temporary fixation hinges. In addition, the temporary fixation hinge 45A is cut off at the two places, that is, the thin portions 43A, so that the unnecessary temporary fixation hinge 45A is perfectly removed from the housing body 2 and the rear holder 3A. Accordingly, the working efficiency of installation can be improved. In addition, since no cut-off pieces of the temporary fixation hinge 45A are left, the reliability of the connector can be further improved.

Next, a fourth embodiment of a rear holder integral-type connector according to the present invention will be described with reference to FIGS. 10 to 13. This fourth embodiment is different from the first embodiment in the point that the configuration of the temporary fixation hinge is modified.

Figure 10:
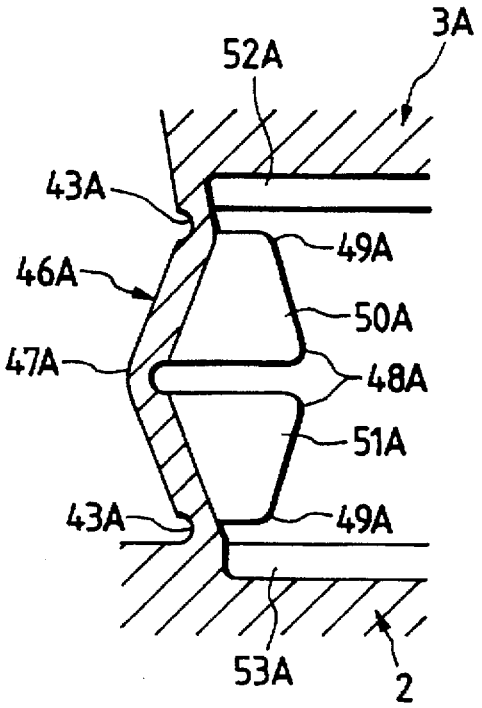
FIG. 10 is a sectional view illustrating an example of a temporary fixation member in a fourth embodiment of a rear holder integral-type connector according to the present invention.

As shown in FIG. 10, a temporary fixation hinge 46A has thin portions 43A at its both end sides, that is, on the housing body 2 side and on the rear holder 3A side in the same manner as in the previous embodiment.

In addition, a middle thick portion 47A as shown in FIG. 7 is provided at the center portion of the temporary fixation hinge 46A, and the hinge 46A is formed into an approximate C-shape so that the center portion of the hinge protrudes forward. Further, a pair of ribs 50A and 51A each of which has a stopper portion 48A and a fulcrum portion 49A are provided at the rear side of the temporary fixation hinge 46A, and engagement grooves 52A and 53A are provided on the housing body 2 and the rear holder 3A so that the ribs 50A and 51A do not slide during the cutting-off which will be described later.

Figure 11:
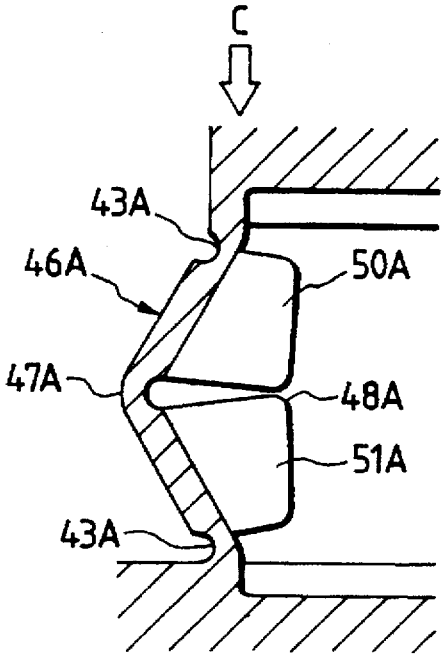
FIG. 11 is a diagram for explaining the operation in FIG. 10 when an external force is given to the temporary fixation member.

Next, as shown in FIG. 11, for example, when an external force C is given to the rear holder 3A which is fixed temporarily, the temporary fixation hinge 46A is bent slightly forward centering the middle thick portion 47A. The stopper portions 48A and 48A of the pair of the ribs 50A and 51A however contact with each other, so that the temporary fixation hinge 46A is prevented from being further bent. Therefore, the thin portions 43A and the middle thick portion 47A in the state of temporary fixation are protected from an external force, so that the reliability of the connector can be improved.

Figure 12:
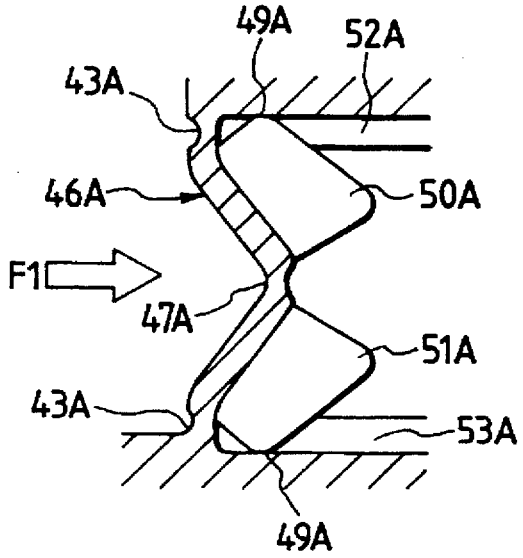
FIG. 12 is a diagram for explaining the operation in FIG. 10 in the midway of working to cut off the temporary fixation member.

Next, as shown in FIG. 12, the temporary fixation hinge 46A can be cut off with a simple tool or empty hands without using any special tool in the same manner as the above-mentioned temporary fixation hinges. That is, when the middle thick portion 47A is pushed from the front of the temporary fixation hinge 46A by a force F1, the temporary fixation hinge 46A is bent backward, so that the fulcrum portions 49A of the pair of the ribs 50A and 51A are engaged with the engagement grooves 52A and 53A.

Figure 13:
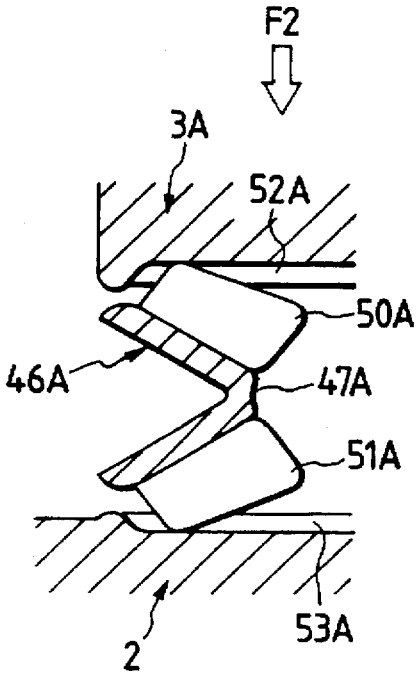
FIG. 13 is a diagram for explaining the operation in FIG. 10 when the temporary fixation member has been cut off.

As shown in FIGS. 12 and 13, the temporary fixation hinge 46A is made to be inverted C-shaped by the force F1. If a force F2 is given from above as shown in FIG. 13, the temporary fixation hinge 46A is further bent with the fulcrum portions 49A and 49A as pivotal axes, so that the thin portions 43A and 43A at the opposites ends of the middle thick portion 47A are cut off surely and easily by the comparatively small force F2 before the middle thick portion 47A is cut off. Therefore, the working efficiency of installation can be further improved. In addition, since the cut-off pieces of the temporary fixation hinge 46A do not remain, the reliability of the connector can be further improved.

Figure 14:
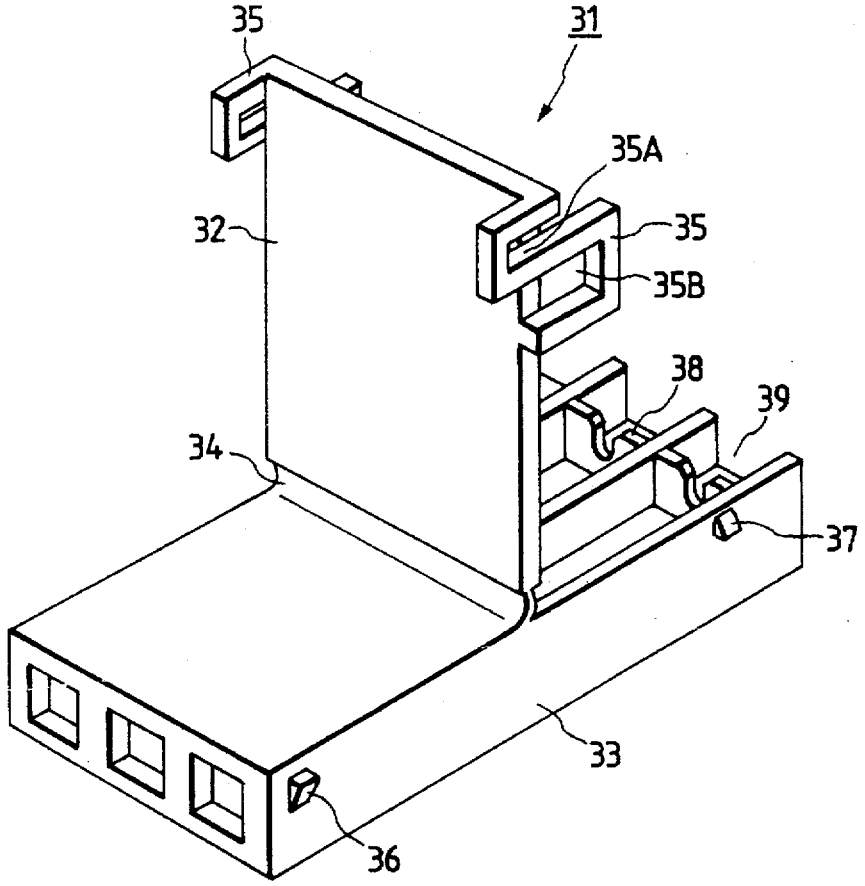
FIG. 14 is a perspective view illustrating a fifth embodiment of a rear holder integral-type connector according to the present invention.
Figure 15:
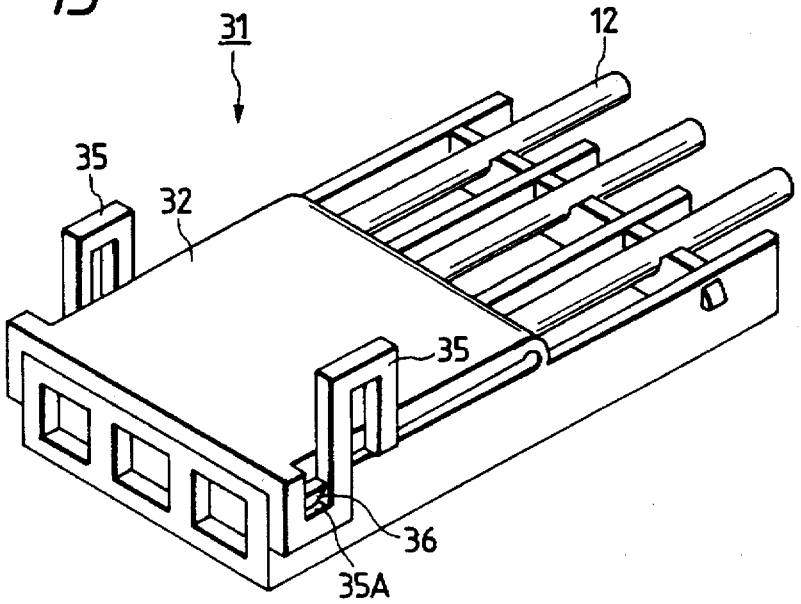
FIG. 15 is a perspective view illustrating the state where a rear holder in FIG. 14 is locked temporarily.
Figure 16:
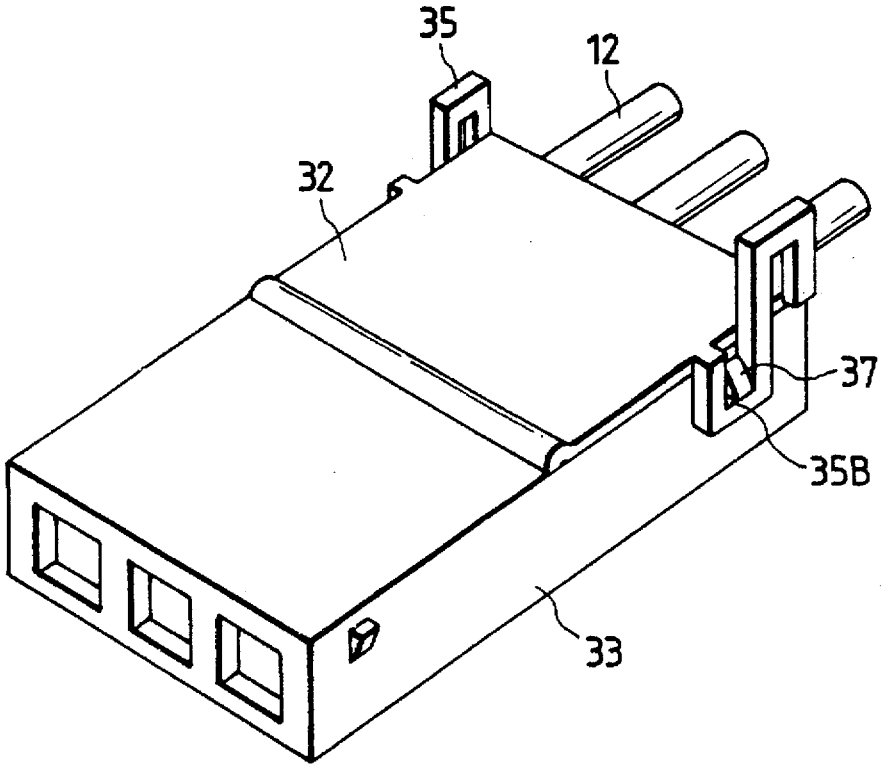
FIG. 16 is a perspective view illustrating the state where the installation in FIG. 14 is completed.
Figure 17:
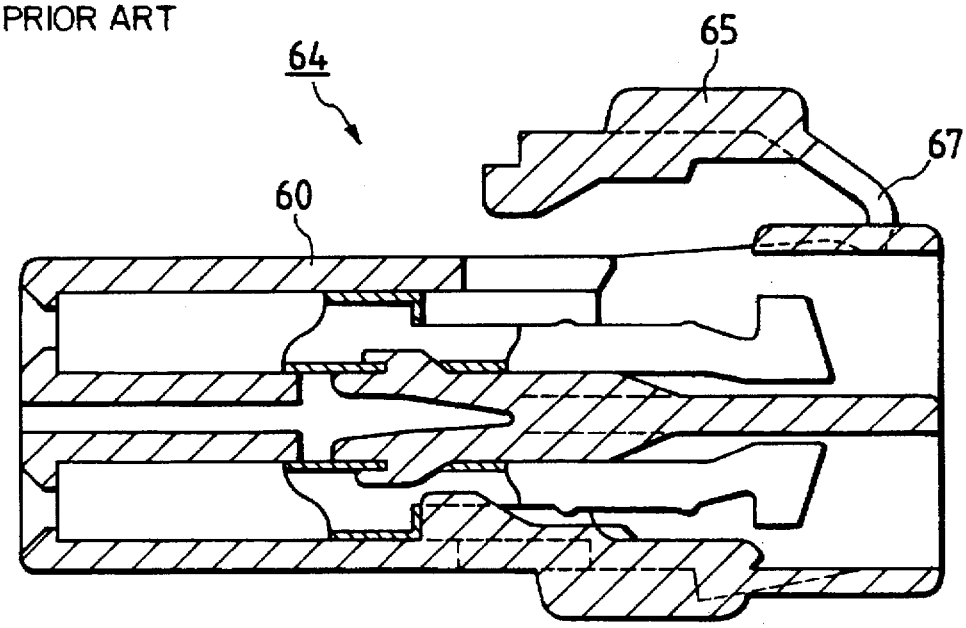
FIG. 17 PRIOR ART
FIG. 17 is a sectional view of a conventional rear holder integral-type connector.

Next, a fifth embodiment of a rear holder integral-type connector according to the present invention will be described with reference to FIGS. 14 to 16. FIG. 14 is a perspective view illustrating the fifth embodiment of the rear holder integral-type connector according to the present invention; FIG. 15 is a perspective view illustrating the state where a rear holder of FIG. 14 is locked temporarily; and FIG. 16 is a perspective view illustrating the state where installation is completed.

As shown in FIG. 14, in a rear holder integral-type connector 31, a lock portion 35 bent into an approximate S-shape so as to form locking holes 35A and 35B is provided on at least one side end of a rear holder 32. A temporary locking projection 36 which is a temporary fixation member, and a locking projection 37 are provided on a housing body 33.

Next, the operation will be described. As shown in FIG. 15, the rear holder 32 is pushed down toward the housing body 33 so that the locking hole 35A is temporarily locked onto the temporary locking projection 36 of the housing body 33. Here, electric wires 12 are pressed and connected to pressing blades 38 of terminal reception chambers 39 by an automatic installer or the like. After that, the rear holder 32 is removed from the temporary locking projection 36, and rotated with a hinge 34 as a pivotal axis so that the rear holder 32 is closed. The locking hole 35B is locked onto the locking projection 37 of the housing body 33 as shown in FIG. 16.

With this configuration, there is no scattering in the shape of the temporary locking state, so that the stable shape can be realized. Accordingly, this embodiment is optimum for an automatic installation step, and the rear holder 32 can be easily released from the temporary locking state without using any tool.

As has been described above, in a rear holder integral-type connector according to the present invention, steps of working at the time of installation, such as a step of inserting terminals into a housing, a step of connecting electric wires, etc., can be performed smoothly by temporarily fixing a rear holder. Therefore, the rear bolder integral-type connector of the present invention has a conspicuous effect especially in automatic installation in a pressure contact connector in which electric wires are press-connected.

Further, when the respective steps of working are completed, a temporary fixation hinge is cut off so that the rear holder can be rotated. Accordingly, the working of attaching the rear holder after the temporary fixation hinge is cut off can be performed smoothly. In addition, the shape of the temporary locking is so stable that an automatic installer can be used easily.

As has been described above, a rear holder integral-type connector according to the present invention has a separable temporary fixation member for temporarily fixing a rear holder to a housing body in the condition that the rear holder is left opened.

Therefore, the rear holder formed integrally with the housing body through a displaceable hinge is further fixed to the housing body temporarily in the condition that the rear holder is left opened. Accordingly, there is no fear that the rear holder or the hinge is injured even if an external force is given thereto, so that the reliability of the connector can be ensured. In addition, the rear holder is not an obstacle when terminals are inserted by an automatic installer or when electric wires are connected. Accordingly, the working of installation can be performed smoothly, so that the workability can be improved conspicuously.

Preferably, the temporary fixation member is a temporary fixation hinge which is formed integrally to couple the housing body and the rear holder with each other, and which is cut off when the rear holder is closed.

Accordingly, not only it is possible to hold the temporary locking state surely even if an external force is given, but also it is possible to cut off the temporary fixation hinge with a cutting tool easily after the working of connecting wires, or the like. It is therefore possible to perform the working of locking of the rear holder onto the housing body easily.

As a result, the performance of installation of the connector can be improved conspicuously.

When an appropriate number of thin portions are provided in the temporary fixation member, the temporary fixation member can be cut off with empty hands or a simple tool easily after the working of connecting wires or the like.

Accordingly, the workability of installation of the connector can be improved conspicuously, and the reliability of the connector can be also improved.

When the thin portions are provided at the both ends of the temporary fixation member, the temporary fixation member is perfectly removed after the temporary fixation member is cut off.

Accordingly, there is no fear that useless cut-off pieces projects over the housing body and on the rear holder after the installation is completed. Accordingly, the reliability of the connector can be further improved, and the security in working can be also ensured.

In another case, thin portions are provided at the opposite ends of the temporary fixation member while a middle thick portion is provided at a center portion thereof, and a pair of ribs each of which has a stopper portion and a fulcrum portion are provided at the rear of the temporary fixation member.

As a result, the thin portions are protected from an external force acting on the rear holder, and the temporary fixation member can be cut off surely and easily.

Accordingly, the shape in the step of working the connector is so stable that the workability can be improved, and an automatic installer can be used easily.

In another case, the temporary fixation member is a temporary locking projection provided on the housing body to temporarily lock a locking hole provided in at least one side end of the rear holder.

As a result, the opening/closing operation of the rear holder can be performed easily without using any tools. In addition, the shape of the connector in the step of working the connector is so stable that an automatic installer can be used easily.

What is claimed is:

1. A rear holder integral connector, comprising:

a housing body including a plurality of terminal reception chambers for receiving connection terminals to which electric wires are connected respectively;

a rear holder coupled with said housing body through a displaceable hinge; and a separable temporary fixation member for temporarily fixing said rear holder to said housing body in a condition that said rear holder is opened, wherein said temporary fixation member is integral with said housing body and said rear holder to couple said housing body and said rear holder with each other, said fixation member being severable to allow closure of said rear holder.

2. A rear holder integral connector according to claim 1, wherein said temporary fixation member has a thin section.

3. A rear holder integral connector according to claim 2, wherein said temporary fixation member is provided with said thin section at a center portion of said temporary fixation member, and said temporary fixation member is integrally provided with a guide rib on either side of said thin section respectively.

4. A rear holder integral connector according to claim 3, wherein said rear holder is provided with a locking side piece, and said housing body is provided with a locking groove for locking said locking side piece when said rear holder is closed.

5. A rear holder integral connector according to claim 2, wherein said temporary fixation member is provided with said thin section at an upper and a lower end of said temporary fixation member and a center portion of said temporary fixation member has a thick section, and said temporary fixation member is provided with a plurality of ribs, each of which has a stopper portion and a fulcrum portion, at a rear side of said temporary fixation member above and below said thick section respectively.

6. A rear holder integral connector according to claim 5, wherein said rear holder is provided with a locking side piece, and said housing body is provided with a locking groove for locking said locking side piece when said rear holder is closed.

7. A rear holder integral connector according to claim 2, wherein said rear holder is provided with a locking side piece, and said housing body is provided with a locking groove for locking said locking side piece when said rear holder is closed.

8. A rear holder integral connector according to claim 1, wherein said rear holder is provided with a locking side piece, and said housing body is provided with a locking groove for locking said locking side piece when said rear holder is closed.

9. A rear holder integral connector according to claim 1, wherein at least one side end of said rear holder is provided with a locking hole, and said temporary fixation member is a temporary locking projection provided on said housing body to temporarily lock said locking hole.

* * * * *